US007207149B2

(12) United States Patent
Fyfe et al.

(10) Patent No.: US 7,207,149 B2
(45) Date of Patent: Apr. 24, 2007

(54) ANCHOR AND METHOD FOR REINFORCING A STRUCTURE

(76) Inventors: Edward R. Fyfe, 1339 Ocean Ave., Del Mar, CA (US) 92014; Steven T. Brokken, 916 Ordway St., Albany, CA (US) 94706

( * ) Notice: Subject to any disclaimer, the term of this patent is extended or adjusted under 35 U.S.C. 154(b) by 260 days.

(21) Appl. No.: 10/205,294

(22) Filed: Jul. 24, 2002

(65) Prior Publication Data

US 2004/0016200 A1 Jan. 29, 2004

(51) Int. Cl.
*E04C 5/00* (2006.01)
*E04C 5/12* (2006.01)

(52) U.S. Cl. ..... 52/698; 52/712; 52/745.21; 52/742.14; 52/223.13; 52/223.14; 156/73.2

(58) Field of Classification Search ..... 52/698–701, 52/703, 706–711, 712–715, 742.13, 742.14, 52/745.21, 223.1, 223.13, 223.14; 156/71, 156/73.2

See application file for complete search history.

(56) References Cited

U.S. PATENT DOCUMENTS 2,371,882 A * 3/1945 Freyssinet ..... 52/223.13
2,593,022 A * 4/1952 Grivel et al. ..... 52/714
2,637,885 A * 5/1953 Silver ..... 24/113 R
2,751,881 A * 6/1956 Burkey ..... 119/219
2,809,586 A * 10/1957 Roberts ..... 102/219
3,222,842 A * 12/1965 Luedloff et al. ..... 52/741.11
3,461,639 A * 8/1969 Merrill ..... 52/742.14
3,530,631 A * 9/1970 Merrill ..... 52/414
3,757,528 A * 9/1973 Finsterwalder et al. ..... 405/239
3,820,832 A * 6/1974 Brandestini et al. ..... 24/115 A
3,877,235 A * 4/1975 Hill ..... 405/259.6
4,056,036 A * 11/1977 Kamann et al. ..... 405/259.5
4,409,764 A * 10/1983 Wilnau ..... 52/127.3
4,838,970 A * 6/1989 Thibos ..... 156/169
5,016,411 A * 5/1991 Thorsnes ..... 52/220.4
5,567,374 A * 10/1996 Thicthener et al. ..... 264/137
5,617,685 A * 4/1997 Meier et al. ..... 52/223.8
5,649,398 A 7/1997 Isley, Jr. et al. ..... 52/309.17
5,657,595 A 8/1997 Fyfe et al. ..... 52/252
5,678,382 A * 10/1997 Naito ..... 52/745.21
5,713,169 A * 2/1998 Meier et al. ..... 52/223.13
5,809,712 A * 9/1998 Simanjuntak ..... 52/223.7
5,845,457 A * 12/1998 Wybauw ..... 52/745.2
6,216,403 B1 * 4/2001 Belbeoc'h ..... 52/223.13
6,367,214 B1 * 4/2002 Monachino ..... 52/247
6,524,045 B2 * 2/2003 Pourtier ..... 411/60.1
6,526,722 B1 * 3/2003 Pangburn ..... 52/698
6,647,674 B1 * 11/2003 Lancelot et al. ..... 52/125.4

* cited by examiner

*Primary Examiner*—Jeanette Chapman
(74) *Attorney, Agent, or Firm*—MaryJo Redman; Calif Tervo; Palomar Patent

(57) ABSTRACT

Anchor 10 for reinforcing a structure against displacement forces and a method of installation includes drilling a borehole 50 in an anchor medium 110 adjacent the structure A length of roving 21 composed of filaments 24 is doubled and pushed into borehole 50 with free end 23 of roving 21 protruding. Backfill grout 41 or resin 42 is pumped or poured into bore hole 50 to embed roving 21 Filaments 24 of free end 23 are spread apart and attached to the structure by adhesive.

19 Claims, 2 Drawing Sheets

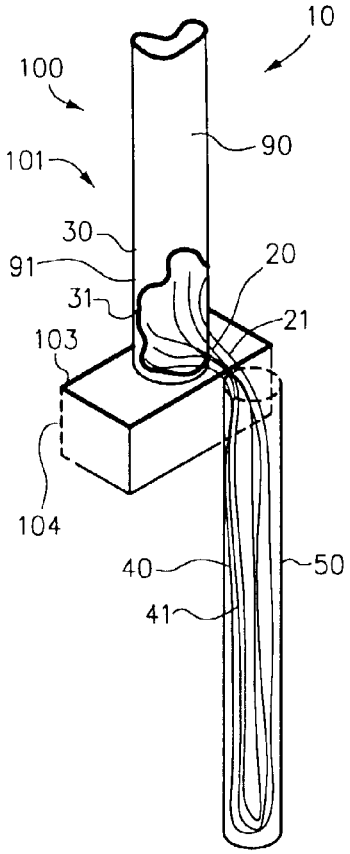
FIG. 1
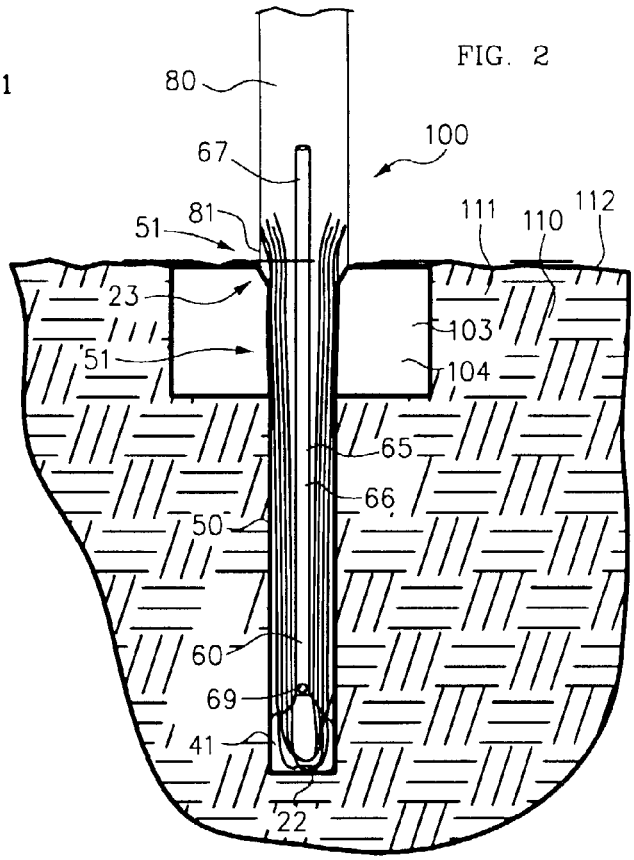
FIG. 2
FIG. 3
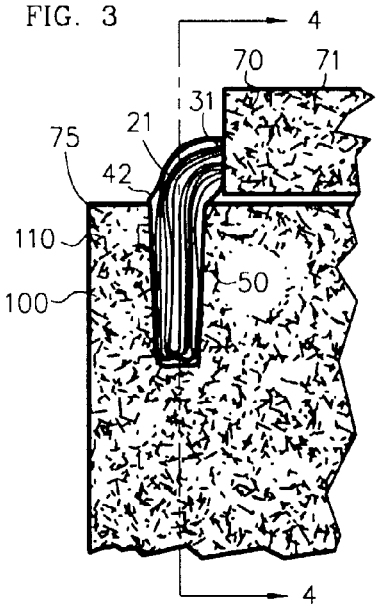
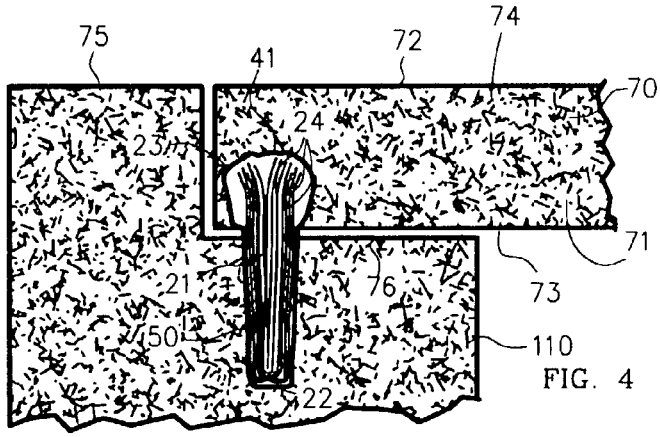
FIG. 4

FIG. 5
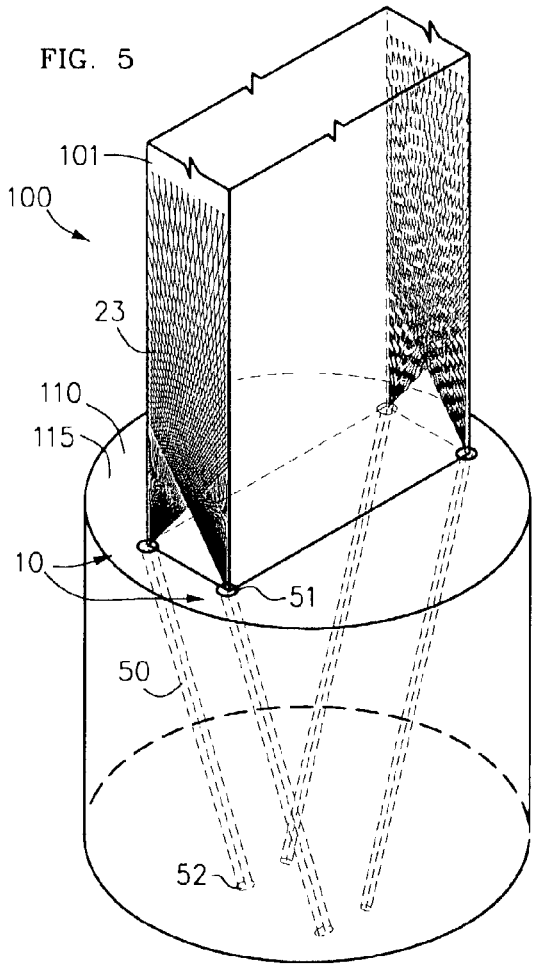
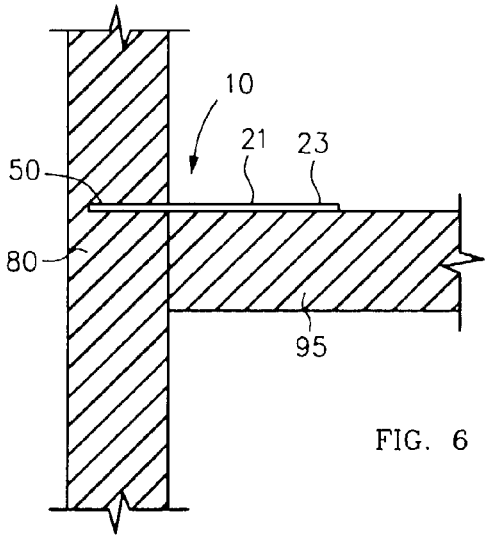
FIG. 6
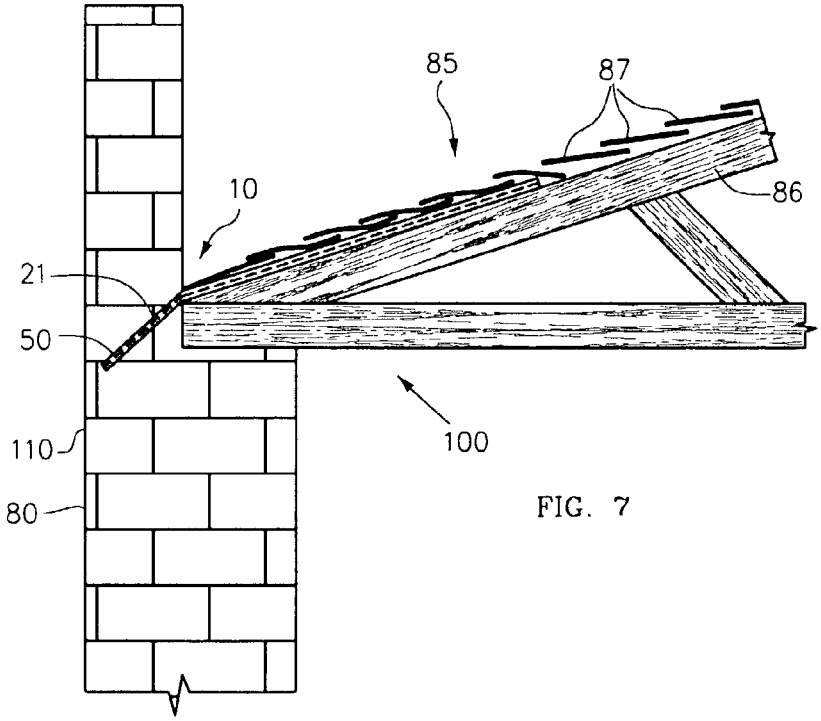
FIG. 7

ANCHOR AND METHOD FOR REINFORCING A STRUCTURE

FIELD OF THE INVENTION

This invention relates in general to reinforcing a structure, and more particularly to an anchor for reinforcing existing buildings and other structures.

BACKGROUND OF THE INVENTION

Buildings have traditionally been designed to support their own weight plus that of expected inhabitants and furnishings. Buildings and other structures for supporting weight have long been expected to be very strong under vertical compression. Concrete is a favorite material for weight-bearing structures because it is inexpensive and has exceptional compressive strength.

In the mid-1900s, architects began to take lateral forces into account more than they had previously. Wind can exert strong lateral force on tall buildings and long bridges Smaller structures were still designed without much regard for strong lateral forces, though, until concern for earthquake resistance began growing in the 1970s in the United States, partly due to the massive Anchorage earthquake in 1964.

As understanding of the risk of earthquake increases, building codes require increasing resistance to lateral forces. Discovery of more earthquake faults all the time keeps increasing the area of inhabited land that is known to be at risk from earthquakes. Lateral forces on structures can also result from hurricanes, tornadoes, explosion, and impact.

Many buildings are still in use that were not built to withstand strong lateral forces. Some smaller structures, such as stadium seating and library shelves, have almost no built-in resistance to lateral forces. These could be toppled or collapsed by an earthquake and kill or injure people.

There is a need for a means to reinforce old structures so that they resist strong lateral force, such as could be caused by earthquake, storm, or explosion. Some present techniques for reinforcing structures require encapsulation of the structure in steel rods or panels, sprayed-on concrete, or resin-impregnated fiber panels. Other techniques require extensive excavation next to the structure or addition of external buttresses. These present techniques have disadvantages and are not applicable to all situations.

Encapsulation is generally undesirable in the case of an historical structure and is not feasible for all types of structures. There is frequently not room available for techniques that require excavation, external reinforcing members, or thickening of the structure. Many beautiful structures have been demolished or stand unused because no means could be found to make them safe enough. Other structures have been abandoned because the owner could not afford the high cost of reinforcement.

The anchor of the present invention is an inexpensive and effective way to reinforce many types of structure. The present invention can be installed in a small area with minimal disruption of the functioning of the structure. The invention is an efficient way to reinforce stadium seats, large shelves, or building elements including columns, walls, and beams.

SUMMARY OF THE INVENTION

The present invention is an anchor for reinforcing a structure and a method of installing the anchor. The anchor is a slender "mini-piling" of fiber roving embedded in a resin or grout and attached to the structure.

To install the anchor, a hole is bored into an anchor medium adjacent the structure For example, the hole may be bored vertically in the ground next to a wall or column or horizontally into an adjacent beam or wall. A length of fiber roving is doubled, then pushed into the bore hole such that the doubled-over middle of the length of roving is near the bottom of the hole. The free ends of the roving are left protruding from the hole. The roving is a loosely-twisted bundle of fibers having high tensile strength, such as fibers of polyaramid, graphite, or glass.

The bore hole is backfilled, typically by injecting a fluid that solidifies spontaneously, such as a cementitious grout or synthetic resin. The backfill material embeds the roving and anchors it to the ground.

The filaments of the free ends of the roving are spread apart and attached to a portion of the structure, such as by an adhesive resin having very good tensile strength The attachment is done such that there is little or no slack in the roving between the backfill material and the structure.

After the materials used to backfill the bore hole and to attach the free ends to the structure have hardened, any lateral motion of the structure relative to the borehole that puts tensile force on the roving is opposed by the roving. More than one anchor of the present invention may be attached to a structure to oppose forces in different directions.

Typical applications for the anchor of the present invention are strengthening buildings against earthquakes, preventing stadium seating from toppling off the supports, or strengthening a wharf that may be struck by a ship.

The invention will now be described in more particular detail with respect to the accompanying drawings, in which like reference numerals refer to like parts throughout.

BRIEF DESCRIPTION OF THE DRAWINGS

FIG. 1 is a perspective environmental view, partially cut-away, of the anchor of the present invention strengthening a column.

FIG. 2 is a front view of the anchor of FIG. 1, shown in the process of installation.

FIG. 3 is a side view of the anchor of the present invention strengthening a bench supported by a support member.

FIG. 4 is a front view of the anchor of FIG. 3, partially in section.

FIG. 5 is an alternative environmental perspective view of the anchor of the present invention, shown anchoring a structure to a piling.

FIG. 6 is sectional view of an alternative embodiment of the present invention anchoring a roof to a wall.

FIG. 7 is a sectional view of another alternative embodiment of the present invention anchoring a floor to a wall.

DETAILED DESCRIPTION OF THE DRAWINGS

FIG. 1 is a perspective environmental view, partially cut-away, of the anchor 10 of the present invention strengthening a structure 100, such as column 90. FIG. 2 is a front view of anchor 10 of FIG. 1, shown in the process of installation. Column 90 includes a foundation 103, such as footing 104 below soil surface 112, and a lower part 91 near soil surface 112. Bore hole 50 has been drilled into anchor medium 110, such as soil 111, adjacent column 90.

Anchor 10 generally includes fiber 20, borehole 50, backfill 40, and adhesive means 30. Fiber 20, such as roving 21, is inserted into bore hole 50 with free end 23 protruding. Backfill 40, such as grout 41, is added to bore hole 50 to anchor roving 21 within bore hole 50. Grout 41 fills bore hole 50, embedding roving 21, and adheres to soil 111. Free end 23 is spread apart so that filaments 24 are generally separate. Filaments 24 are attached to column 90, such as to lower part 91, by adhesive means 30, such as by epoxy resin 31.

Roving 21 is typically a loosely twisted length of filaments 24 Filaments 24 are generally the same length as roving 21; that is, roving 21 is not composed of short, fuzzy filaments that hold together by friction. Filaments 24 may be nylon, glass, graphite, polyaramid, or other types of filament that can be manufactured in long strands and that have high tensile strength.

Backfill 40 is preferably a solidifiable fluid that can be poured or injected into bore hole 50 and that hardens without addition of heat or evolution of toxic or obnoxious fumes. Backfill 40 can be a cementitious material, such as grout 41, or a synthetic or natural resin, such as epoxy, polyurethane, acrylic, or other resin that has good cohesive strength. The viscosity of backfill 40, when in the fluid state, is preferably low enough that backfill 40 flows around roving 21 to embed it intimately. Roving 21 may include an adhesion promoting coating on the surface of filaments 24 to increase the adhesion between roving 21 and backfill 40.

Filaments 24 of free end 23 are spread apart, such as by pulling and using the hands to apply shearing force generally perpendicular to the length of roving 21. The separated filaments 24 are splayed against the surface of lower part 91 of column 90.

Filaments 24 are attached to lower part 91 by adhesive means 30, such as epoxy resin 31. Adhesive means 30 may be any of many synthetic or natural resins, such as polyurethane, polyurea, acrylic, latex, or silicone, that have high cohesive strength and that adhere well to roving 21 and the material of structure 100. Adhesive means 30 may also be an inorganic material, such as grout, or a composite, such as a panel of resin-impregnated fiberglass.

After backfill 40 and adhesive means 30 are hardened, motion of column 90 relative to borehole 50 will put tensile force on roving 21, which opposes and limits the motion. More than one anchor 10 can be attached to a structure 100, if needed, to prevent movement in different directions. However, because filaments 24 are splayed over a relatively wide area of structure 100, anchor 10 opposes a range of force vectors. This is an advantage of anchor 10 over reinforcement methods with a single-point attachment, such as a cable or strap. In a further advantage, the tensile force on adhesive means 30 is spread over a wide area, reducing the chance of failure. Reinforcement by a cable or strap may cause a cohesive failure within a structure such that a chunk of the structure could be pulled out by the cable or strap during an earthquake or other lateral force event.

Footing 104 is shown disposed under soil surface 112, although the invention is also effective in the case of an above-ground footing. Borehole 50 has been drilled in soil 111, such as by an auger or by hydraulic drill. Drilling is generally preferred to excavation because excavation requires a wider area of soil surface 112 to be disrupted. Drilling produces a bore hole 50 that is narrow and vertical. This allows anchor 10 to be installed in tight spots, such as between an exterior wall of a building and a nearby sidewalk, without damaging the sidewalk or even interrupting its use. Underground cables, pipes, and other objects can be easily avoided. Borehole 50 can even be drilled inside an occupied building, through the floor to soil 111 below, using special drilling equipment. Any bore means may be used to make borehole 50 if the bore means can produce a hole that is adjacent structure 100, without damaging other structures 100 or disrupting the use of structure 100.

In the preferred embodiment shown, roving 21 has been folded in half. Doubling roving 21 causes roving 21 to have a central bent part 22. Insertion means 60, such as an elongate pole, such as tube 66, is placed against bent part 22 of roving 21 Bent part 22 is pushed into bore hole 50 by applying pressure to top end 67 of tube 66 until bent part 22 is in the bottom 52 of bore hole 50. Free end 23 of roving 21 remains protruding from the top 51 of bore hole 50. It is not essential that bent part 22 be located at the extreme bottom of bore hole 50; however, it is more efficient that bore hole 50 be drilled no deeper than necessary to accommodate doubled roving 21.

Doubling roving 21 has two advantages. First, bent part 22 can be pushed into bore hole 50 by simply pressing it with tube 66. A special tool with means for grasping roving 21 is not needed. Second, the weight of backfill 40 on bent part 22 helps to mechanically anchor roving 21 into bore hole 50. When roving 21 is installed as a single strand, roving 21 is anchored almost solely by the adhesive forces between roving 21 and backfill 40. After roving 21 has been put in place by pushing it with tube 66, backfill 40 is added to fill bore hole 50. Although backfill 40, such as cementitious grout 41, could simply be poured into top 51 of bore hole 50, it is preferred that grout 41 be injected to bore hole 50 by injection means 65, starting at bottom 52 of bore hole 50.

In the embodiment of FIG. 2, backfill material injection means 65 is tube 66. Tube 66 includes an opening 69 near the bottom end 68. Grout 41 is pumped, such as by a compressed air pump, or poured into top end 67 of tube 66. Grout 41 flows through tube 66 and emerges from opening 69 into bottom 52 of bore hole 50. Injecting grout 41 into bottom 52 causes the air within bore hole 50 to be displaced upward, so that pockets of air are not trapped by grout 41.

Tube 66 may be withdrawn from bore hole 50 as the level of grout 41 rises. Tube 66 may also be left in place inside bore hole 50, where tube 66 will have a neutral effect on the strength of anchor 10. Tube 66 is preferably constructed of inexpensive, lightweight material, such as polyvinylchloride (PVC) pipe.

The dimensions of bore hole 50 and of roving 21 depend upon several variables The weight of structure 100, the expected displacement forces, and the number of anchors 10 used to reinforce structure 100 are quantities that will determine the strength each anchor 10 needs. Roving 21 and backfill material 40 generally have known specific strengths. The cohesive strength of anchor medium 110 generally should be tested for each application. For example, if anchor medium 110 were loose sandy soil, borehole 50 must be deeper than if anchor medium 110 were concrete. A test anchor 10 may be prepared and its tensile strength measured.

The embodiment shown in FIGS. 1 and 2 is a vertical column 90 reinforced by a generally vertical anchor 10 attached to the generally vertical surface of lower part 91. In some cases, it could be preferable to orient anchor 10 horizontally, such as by drilling bore hole 50 into an adjacent boulder or hillside. In such a case, top 51 of bore hole 50 would be defined as the part of bore hole closest to structure 100 and bottom 52 would be defined as the part of bore hole 50 deepest within anchor medium 110, such as rock or soil. The method of installation would be substantially identical to that described above, except that it might be necessary to cover top 51 with a cover having an opening to allow passage of tube 66. Such a cover would prevent grout 41 from flowing out of bore hole 50 due to gravity before grout 41 hardens.

FIG. 3 is a side view of anchor 10 of the present invention being used to reinforce a horizontal structure 100, such as beam 70. FIG. 4 is a front view of anchor 10 of FIG. 3, partially in section. Beam 70 is supported by support structure 75 and rests on supporting face 76. Supporting face 76 extends past side face 74 of beam 70 and is shown cut away.

Beam 70 may be a bench 71, such as is used for seating in sports stadiums. People can sit directly on bench 71 or chairs may be attached along upper face 72 of bench 71. Support structure 75 is typically a massive member of wood, steel, aluminum, or concrete. Bench 71 is typically wood, steel, aluminum, concrete, or plastic.

It was once considered sufficient that bench 71 be lightly attached to support 75. Especially in the case of bench 71 being of concrete, friction between supporting face 76 and lower face 73 of bench 71 was often the only attachment between bench 71 and support 75. Friction and the weight of bench 71 will usually keep bench 71 in place against ordinary jostling by people or cleaning equipment, but does not restrain bench 71 in the case of an earthquake or explosion.

Earthquakes, explosions, hurricane winds, and massive impacts can produce upward, as well as lateral forces; and vibratory, as well as steady unidirectional, forces. Upward and vibrating forces negate friction and weight as stabilizing means for structures.

To be safe during an earthquake or other calamity, bench 71 must be anchored positively against lateral and upward forces. One bench 71 falling from its support 75 could injure the people sitting on bench 71 or in the row in front of it, but many benches 71 being dislodged in a steeply-raked stadium could kill people below them, or could even result in failure of part of the stadium itself. Even if the stadium were empty at the time of the earthquake, poorly anchored benches 71 could produce property damage and the stadium would be out of use until benches 71 were re-installed.

The anchor of the present invention is well-suited for reinforcing poorly anchored existing benches.

In the embodiment shown in FIG. 3, bore hole 50 is drilled into supporting face 76, such as with a hand-held electric drill. Bore hole 50 could also have been drilled horizontally into support 75, although it is generally more convenient to drill vertically downward.

A doubled length of roving 21 has been inserted into bore hole 50. Backfill 40, such as epoxy resin 42, fills bore hole 50 and embeds roving 21. Protruding free end 23 is splayed apart and attached to side face 74 of bench 71 by adhesive means, such as epoxy adhesive 31. Epoxy adhesive 31 preferably extends down roving 21 to encapsulate the entire portion of roving 21 that protrudes from bore hole 50. By enclosing all parts of roving 21 in solidifiable material, roving 21 is protected from careless or malicious cutting, abrasion, or burning of filaments 24.

The small scale of anchor 10 needed to reinforce bench 71 allows insertion means 60 to be almost any elongate tool, such as a screwdriver, plastic drinking straw, or wooden dowel. Insertion means 60 and injection means 65 may be the same tool, such as a hollow needle attached to a hand- or air-activated pump for injecting epoxy 42. When reinforcing bench 71 or similar small scale application, the needle would typically be withdrawn from bore hole 50 as epoxy resin 42 is injected. If the tip of the needle is maintained just above the level of epoxy resin 42 as the level rises, the needle may easily be wiped off and used repeatedly Epoxy backfill resin 42 and epoxy adhesive 31 are synthetic resins that adhere well to many construction materials and have good cohesive strength. Other synthetic and natural resins with these qualities may also be used. Inert filler material may be included in epoxy backfill resin 42 or epoxy adhesive 31, or both, in order to make the thermal expansion characteristics of backfill resin 42 and epoxy adhesive 31 more similar to those of support 75 and bench 71.

It is preferred that adhesive means 30, roving 21, and backfill material 40 be water resistant and able to retain their strength over long periods of time, even when exposed to thermal cycling, including that due to seasonal and diurnal variation. It is preferred, in some cases, that adhesive means 30, roving 21, and backfill material 40 include additive or coating, not shown, to render the materials more resistant to ultraviolet radiation and fire.

Although roving 21 is preferably composed of high strength filaments 24, it is foreseen that roving 21 may break under great stress. It is generally preferred that anchor 10 should fail in a ductile, gradual manner, rather than in a brittle, sudden manner. For this reason, roving 21 may be composed of more than one type of filament 24. For example, glass filaments 24 may be intermixed with graphite filaments 24; or graphite filaments of different diameters may be mixed within roving 21. The filaments 24 with lower elongation will break first, then the filaments 24 with greater elongation will stretch, and finally the stretched filaments 24 of greater elongation will snap. This preferred behavior is known as ductile performance.

If all filaments 24 were of equal strength and elongation, the breakage of a few filaments 24 would cascade rapidly into sudden breakage of all filaments 24. This non-preferred behavior is known as brittle performance.

FIG. 5 is an alternative environmental perspective view of anchor 10 of the present invention, shown anchoring stanchion 101 of structure 100, such as a wharf, to a piling 115. Depending upon the location, a wharf can experience a wide range of forces from wave action, which vary in amplitude and direction. Energetic waves, such as those caused by storms, may be amplified by harmonic resonance of the wharf and cause catastrophic damage. Stud 101 is illustrated in FIG. 5 as having four anchors 10 attached. Boreholes 50 of anchors 10 slant inward so as to be substantially underneath stud 101. The four anchors 10 cooperate to reinforce stud 101 against excessive movement in any direction, including vertically away from pilling 115. A wharf is also vulnerable to lateral forces from ships colliding with the wharf. Anchors 10 arranged as in FIG. 5 strengthen the attachment of stanchion 101 to piling 115 against collision forces from any direction.

Free ends 23 of roving 21 are shown attached to the two opposite narrow faces of stanchion 101. Free ends 23 could alternatively be attached to the two opposite wider faces of stanchion 101, or to all four faces of stanchion 101, depending on the orientation of stanchion 101 and the direction from which the largest forces are expected.

FIG. 6 is sectional view of an alternative embodiment of anchor 10 of the present invention anchoring a roof 85 to a wall 80 of a building. FIG. 7 is a sectional view of another alternative embodiment of anchor 10 anchoring a floor 95 to wall 80. Both embodiments would be useful for strengthening a building against forces that would tend to temporarily cause floor 95 or roof 85 to move horizontally with respect to wall 80, possibly causing floor 95 or roof 85 to become detached from wall 80. Such lateral forces could result from earthquake, explosion, or violent wind.

In FIG. 6, borehole 50 is depicted as bored horizontally into wall 80 and roving 21 lies horizontally upon floor 95. In FIG. 7, borehole 50 is bored at an angle to truss 86 of roof 85. This angle provides added stiffening against vertical movement of roof 85, such as that caused by violent wind that could otherwise lift roof 85 off of wall 80. Roving 21 is attached to truss 86 and then covered by shingles 87, such that anchor 10 is unseen after completion of roof 85.

Another application, not illustrated, is that of reinforcing top-heavy items, such as library shelves, inside a building. Large libraries, such as a university library, often have free-standing shelf units forming aisles throughout the open space. Shelf units may be quite tall, requiring users to stand on ladders to reach the upper shelves. People can be killed or injured by toppled shelf units and even by books spilled out of swaying shelf units in earthquakes. Shelf units adjacent a wall are frequently attached to the wall by metal brackets or straps. Shelf units not adjacent a wall are sometimes bolted to the floor.

In both cases, the anchor system is only as strong as a rather small area of the wall or floor. Installation of a mechanical fastener may actually damage the wall or floor. A strong force may pull or pop a piece out of the wall or floor, causing failure of the anchor system and allowing the shelf unit to fall.

The anchor of the present invention is better suited than mechanical anchors, such as bolts, for use on walls, floors, soil, and other materials of poor or unknown cohesive strength because forces are spread over a large area. If anchor medium 110 is damaged by the drilling of bore hole 50, the damage will be largely repaired by backfill material 40. Anchor 10 may be designed to yield ductile instead of brittle failure under catastrophic forces by mixing filaments 24 of different strengths, by selecting ductile filaments 24, or by using a ductile or elastomeric resin as adhesive means 30.

As noted above, anchor 10 can be installed while a structure, such as a building, is occupied and in use. The use of drilling instead of excavation to create bore hole 50 allows anchor 10 to be placed in a small area and to avoid damaging nearby pipes, conduits, or even trees. Adhesive means 30 and backfill 40 are preferably materials that do not emit toxic or annoying fumes and that harden to the touch within a few hours. Having described the invention, it can be seen that it provides a convenient and efficient anchor and method for reinforcing existing and new structures of many types.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. An anchor for a structure having a surface adjacent an anchor medium, including:

a borehole in the anchor medium adjacent the structure; including:

a top;

a length of roving comprising a bundle of filaments of high tensile strength partly disposed within said borehole including:

a free end protruding from said top of said borehole; said filaments of said free end splayed on the surface of the structure;

adhesive attaching said splayed filaments of said free end of said roving to the surface of the structure; and backfill material filling said borehole and surrounding said roving such that said roving is anchored against removal from said borehole.

2. The anchor of claim 1, wherein said adhesive is a glue from the group of synthetic resins consisting of epoxy, silicone, polyurea, polyester, or acrylic.

3. The anchor of claim 1, wherein said backfill material includes a solidifiable fluid.

4. The anchor of claim 3, wherein said solidifiable fluid comprises a resin from the group of synthetic resins consisting of epoxy, polyester, and acrylic.

5. The anchor of claim 3, wherein said solidifiable fluid is an inorganic slurry from the group consisting of cementitious grout, clay, and plaster.

6. The anchor of claim 3, said backfill material further including an injection tube used for injecting said solidifiable fluid.

7. In combination:

a structure having a surface;

an anchor medium adjacent said structure; and an anchor attaching said structure to said anchor medium for reinforcing said structure; including:

a borehole in said anchor medium adjacent said structure: including:

a top;

a length of roving comprising a bundle of filaments of high tensile strength partly disposed within said borehole including:

a free end protruding from said top of said borehole; said filaments of said free end splayed on said surface of said structure;

adhesive attaching said splayed filaments of said free end of said roving to said surface of said structure; and backfill material filling said borehole and surrounding said roving such that said roving is anchored against removal from said borehole.

8. The combination of claim 7 wherein said adhesive comprises epoxy resin.

9. The combination of claim 7, said backfill material including a solidifiable fluid.

10. The combination of claim 9, said solidifiable fluid being a member of the group consisting of synthetic resins, inorganic grouts, fiber-reinforced resin, and resin/cement blended grouts.

11. The combination of claim 7, wherein said anchor medium is the ground.

12. An anchor for a structure having a surface adjacent an anchor medium, including:

a borehole in the anchor medium adjacent the structure; including:

a top;

a length of roving comprising a bundle of filaments of high tensile strength doubled over and disposed in said borehole; said length of roving including:

a bent part disposed within said borehole; and a pair of free ends protruding from said top of said borehole; said filaments of said free ends splayed on the surface of the structure;

adhesive attaching said splayed filaments of said free ends of said roving to the surface of the structure; and backfill material filling said borehole and surrounding said roving including said bent part in said borehole such that said roving is anchored against removal from said borehole.

13. The anchor of claim 12, wherein said adhesive is a glue from the group of synthetic resins consisting of epoxy, silicone, polyurea, polyester, or acrylic.

14. In combination:

a structure having a surface;

an anchor medium adjacent said structure; and a plurality of anchors attaching said structure to said anchor medium for reinforcing said structure; each anchor including:

a borehole in said anchor medium adjacent said structure: including:

a top; and a longitudinal axis;

a length of roving comprising a bundle of filaments of high tensile strength partly disposed within said borehole including:

a free end protruding from said top of said borehole; said filaments of said free end splayed on said surface of said structure;

adhesive attaching said splayed filaments of said free end of said roving to said surface of said structure; and backfill material filling said borehole and surrounding said roving such that said roving is anchored against removal from said borehole; wherein a plurality of said longitudinal axes of said boreholes are not parallel.

15. The combination of claim 14, said adhesive comprises epoxy resin.

16. The anchor of claim 1 wherein:

a plurality of said filaments differ in physical properties.

17. The anchor of claim 1 wherein:

a plurality of said filaments differ in diameter.

18. The anchor of claim 1 wherein:

a plurality of said filaments differ in material.

19. The anchor of claim 18 wherein:

a plurality of said filaments differ in diameter.

* * * * *